US011993830B2

(12) United States Patent
Siripurapu et al.

(10) Patent No.: US 11,993,830 B2
(45) Date of Patent: May 28, 2024

(54) WIRES FORMED FROM IMPROVED 8000-SERIES ALUMINUM ALLOY

(71) Applicants: GENERAL CABLE TECHNOLOGIES CORPORATION, Highland Heights, KY (US); NanoAl, LLC, Skokie, IL (US)

(72) Inventors: Srinivas Siripurapu, Milan (IT); Shenjia Zhang, Zionsville, IN (US); Richard Stephen Baker, Cumming, GA (US); Nhon Q. Vo, Skokie, IL (US); Francisco U. Flores, Chicago, IL (US); Davaadorj Bayansan, Glenview, IL (US)

(73) Assignees: General Cable Technologies Corporation, Highland Heights, KY (US); NanoAI, LLC, Skokie, IL (US)

( * ) Notice: Subject to any disclaimer, the term of this patent is extended or adjusted under 35 U.S.C. 154(b) by 406 days.

(21) Appl. No.: 16/198,267

(22) Filed: Nov. 21, 2018

(65) Prior Publication Data

US 2019/0153566 A1 May 23, 2019

Related U.S. Application Data

(60) Provisional application No. 62/589,742, filed on Nov. 22, 2017.

(51) Int. Cl.
*C22C 21/00* (2006.01)

(52) U.S. Cl.
CPC ..... *C22C 21/00* (2013.01)

(58) Field of Classification Search
None
See application file for complete search history.

(56) References Cited

U.S. PATENT DOCUMENTS

| | | | | |
|---|---|---|---|---|
| 5,405,578 | A * | 4/1995 | Setzer | C22C 1/03 420/129 |
| 8,017,072 | B2 | 9/2011 | Pandey | |
| 2011/0079427 | A1* | 4/2011 | Powale | H01B 3/427 174/72 A |
| 2013/0220497 | A1 | 8/2013 | Huskamp et al. | |
| 2015/0132182 | A1* | 5/2015 | Comoret | H01B 13/0006 420/538 |
| 2017/0110704 | A1 | 4/2017 | Siripurapu et al. | |
| 2017/0250003 | A1 | 8/2017 | Yoshida et al. | |

FOREIGN PATENT DOCUMENTS

| | | | |
|---|---|---|---|
| CN | 101418401 | A | 4/2009 |
| CN | 101770828 | A | 7/2010 |
| CN | 102230113 | A | 11/2011 |
| CN | 102363849 | A | 2/2012 |
| CN | 102816960 | A | 12/2012 |
| CN | 106636780 | A | 5/2017 |
| WO | 2014107112 | A1 | 7/2014 |

OTHER PUBLICATIONS

Young, Lee W.; International Search Report and Written Opinion of the International Searching Authority, issued in Int'l. App. No. PCT/US2018/062268; dated Jan. 31, 2019; 7 pages.

Martinavicius, A; Partial Supplementary European Search Report issued in European Patent Application No. 18881317.4; dated Feb. 2, 2021; 15 pages.

Martinavicius, A; Partial Supplementary European Search Report issued in European Patent Application No. 18881317.4; dated Feb. 23, 2021; 15 pages.

* cited by examiner

*Primary Examiner* — Adil A. Siddiqui
(74) *Attorney, Agent, or Firm* — Frost Brown Todd LLP

(57) ABSTRACT

Improved 8000-series aluminum alloys exhibiting improved creep resistance and stress relaxation resistance are disclosed and are useful to form wires. The improved 8000-series aluminum alloys include a rare earth element. The electrical conductivity of the aluminum alloy is substantially unaffected by the addition of the rare earth element.

9 Claims, No Drawings

WIRES FORMED FROM IMPROVED 8000-SERIES ALUMINUM ALLOY

REFERENCE TO RELATED APPLICATIONS

The present application claims the priority of U.S. provisional application Ser. No. 62/589,742, entitled WIRES FORMED FROM IMPROVED 8000-SERIES ALUMINUM ALLOY, filed Nov. 22, 2017, and hereby incorporates the same application herein by reference in its entirety.

TECHNICAL FIELD

The present disclosure generally relates to wires formed of an improved 8000-series aluminum alloy exhibiting high creep resistance and stress relaxation resistance.

BACKGROUND

Cable building wire has predominantly been formed of copper due to copper's high electrical conductivity and excellent mechanical properties. Despite these qualities, it would be advantageous to form cable building wire from an aluminum alloy as a consequence of aluminum's higher electrical conductivity, when compared to copper, on a unit weight basis. However, cable wires formed of typical aluminum alloys exhibit low creep resistance and stress relaxation resistance causing cables formed from such alloys to exhibit poor termination performance making such conductors unsuitable for use in buildings. It would be advantageous to form an improved aluminum alloy which balances high electrical conductivity with high creep resistance and stress relaxation resistance.

SUMMARY

In accordance with one embodiment, a wire is formed from an improved 8000-series aluminum alloy. The improved 8000-series aluminum alloy includes, by weight, about 0.30% to about 0.80% iron, about 0.10% to about 0.3% copper, and about 0.001% to about 0.1% of a rare earth element. The rare earth element is selected from one or more of erbium, ytterbium, and scandium.

In accordance with another embodiment, a wire is formed from an improved 8000-series aluminum alloy. The improved 8000-series aluminum alloy includes, by weight, about 0.30% to about 0.80% iron, about 0.01% to about 0.20% silicon, and about 0.001% to about 0.1% of a rare earth element. The rare earth element is selected from one or more of erbium, ytterbium, and scandium.

DETAILED DESCRIPTION

As will be described herein, aluminum alloys exhibiting a balance of high electrical conductivity as well as high creep resistance and high stress relaxation resistance are disclosed. The aluminum alloys are suitable to form conductors for wires, such as cable building wires. Cables formed from such aluminum alloys can dependably be terminated at building sockets and terminals. Generally, such improved aluminum alloys can be formed through the inclusion of a suitable rare earth element to certain 8000-series aluminum alloys to improve the creep resistance and stress relaxation resistance without impairing the electrical conductivity of the standard 8000-series aluminum alloy.

As can be appreciated, cable building wire is connected to, and terminated at, receptacles such as power outlets.

Termination of cable building wire is typically accomplished by making an electrical connection with the terminal and then using a screw to secure the connection. As can be appreciated, various physical characteristics are important to prevent loosening and failure of a termination over time including the creep resistance and stress relaxation resistance characteristics exhibited by the cable. Creep is the measurement of the rate of change of a material's dimensions over a period of time when subjected to an applied force and controlled temperature. Stress relaxation is the time dependent decrease in stress of a metal under constant strain. Cables formed of metals having low resistance to creep and stress relaxation can deform and can cause undesirable failure of the termination due to loss of electrical contact.

As can be further appreciated, the electrical and mechanical properties of a metal can be influenced through several mechanisms including through the incorporation of additional elements to form alloys and through mechanical and thermal treatment of the metal. Such mechanisms can improve the creep and stress relaxation performance of a metal.

A number of aluminum alloy grades have been standardized by the Accrediting Standards Committee H35 of the Aluminum Association. Standardized aluminum grades are defined by their elemental compositions with the various grades generally intended for specific applications and industries. For example, 1000-series aluminum alloys are defined as being high purity aluminum alloys and 7000-series aluminum alloys are defined as zinc and magnesium containing alloys. 1000-series aluminum alloys are useful in the overhead conductor industry while 7000-series aluminum alloys are useful in the aerospace industry. Certain 8000-series aluminum alloys have been standardized to provide aluminum alloys useful for the construction of cable wires. 8000-series aluminum alloys can include silicon, iron, copper, magnesium, zinc, and boron. Specifically, 8000-series aluminum alloys are defined in ASTM B800-05 (2015) titled "Standard Specification for 8000 Series Aluminum Alloy Wire for Electrical Purposes—Annealed and Intermediate Tempers" and all references herein to 8000-series aluminum alloys means aluminum alloys meeting such qualifications.

Specifically, certain 8000-series aluminum alloys, such as AA8176 and AA8030, can exhibit improved creep and stress relaxation resistance when compared to conventional aluminum alloys, such as AA1350. However, the creep resistance and stress relaxation resistance of such 8000-series alloys is still lower than comparable creep and stress relaxation values for the copper typically used to form cable building wire. This discrepancy can lead to cables formed from 8000-series aluminum alloys to experience termination failure. Applicant has discovered that the addition of rare earth elements to certain 8000-series alloy, such as AA8030, can allow for the formation of an aluminum alloy which exhibits higher creep resistance and stress relaxation resistance while still maintaining the electrical conductivity of the original alloy.

In certain embodiments, a suitable rare earth element can be a heavy metal rare earth element such as one or more of erbium and ytterbium, or a rare earth element such as scandium. For example, in certain embodiments, the addition of trace amounts of erbium can increase the creep resistance, increase the stress relaxation resistance, and increase the tensile strength of an AA8030 alloy without reducing the electrical conductivity or elongation at break values of the original alloy.

As can be appreciated, the elongation at break values of the aluminum alloys described herein can be greater than comparable elongation at break values for copper cable building wires. Improved elongation at break values can facilitate the tension forces required to pull cable wire through walls and plenum. In certain embodiments, the aluminum alloys used to form the cable building wires described herein can have an elongation at break value of about 15% to about 50%.

In certain embodiments, a rare earth element can be added at about 0.001% to about 0.1% by weight of the aluminum alloy including, for example, at about 0.01% by weight of the aluminum alloy, at about 0.02% by weight of the aluminum alloy, at about 0.03% by weight of the aluminum alloy, and at about 0.04% by weight of the aluminum alloy.

In certain embodiments, the rare earth element can be added to a standard 8000-series aluminum alloy, such as AA8030 aluminum alloy. AA8030 aluminum alloys are defined by unified number system ("UNS") AA8030 standard and include, by weight, 0.30% to 0.80% iron, 0.15% to 0.30% copper, 0.10% or less silicon, 0.050% or less magnesium, 0.050% or less zinc, 0.0010% to 0.040% boron, 0.030% or less of each other element with a total of less than 0.10% of each other element, and the balance aluminum. Known AA8030 aluminum alloys can exhibit a tensile creep rate at 100° C. under 45.5 MPa of stress of about $9.8*10^{-6}$ $s^{-1}$ and tensile stress relaxation times to reach 85% of an initial tensile stress of 75 MPa at room temperature (e.g., at about 23° C.) of about 660 seconds.

Alternatively, in other certain embodiments, the rare earth element can be added to an AA8176 or an AA8017 aluminum alloy. AA8176 aluminum alloys include, by weight, 0.40% to 1.00% iron, less than 0.10% zinc, 0.030% to 0.15% silicon, 0.030% or less gallium, 0.050% or less of each other element with a total of less than 0.15% of each other element, and the balance aluminum. AA8017 aluminum alloys include, by weight, 0.55% to 0.80% iron, 0.10% to 0.20% copper, 0.10% or less silicon, 0.05% or less zinc, 0.04% or less boron, 0.01% to 0.05% magnesium, 0.003% or less lithium, 0.03% or less of each other element with a total of less than 0.10% of each other element, and the balance aluminum. As can be appreciated however, the rare earth element can also be added to other aluminum alloys formed of iron, copper, and other elements.

As can be appreciated, certain aluminum alloys described herein can still satisfy the requirements of standardized aluminum alloy grades. For example, the inclusion of about 0.01% to about 0.03%, by weight, of a rare earth element to an AA8030 aluminum alloy is permitted by the AA8030 standard and inventive aluminum alloys $AlFe_{0.44}Cu_{0.17}Si_{0.02}Er_{0.01}$, $AlFe_{0.44}Cu_{0.17}Si_{0.02}Er_{0.02}$, and $AlFe_{0.44}Cu_{0.17}Si_{0.02}Er_{0.03}$, for example, can be considered AA8030 aluminum alloys. Certain inventive aluminum alloys can also be AA8176 or AA8017 aluminum alloys. As can be appreciated however, certain aluminum alloys described herein can alternatively be outside the standards of any named aluminum alloys.

The addition of a rare earth element can increase resistance to tensile creep and resistance to tensile stress relaxation. For example, the addition of about 0.01% to about 0.03% erbium to an AA8030 aluminum alloy can lower the tensile creep rate at 100° C. under 70 MPa of stress to about $1.0*10^{-5}$ $s^{-1}$ to about $2.0*10^{-7}$ $s^{-1}$. As can be appreciated, such improvements can be a 20× to 30×, or even greater, increase in tensile creep resistance as compared to a similar alloy formed without the rare earth element. For an AA8176 aluminum alloy, the addition of about 0.01% to about 0.05% erbium can lower the tensile creep rate to about $2*10^{-7}$ $s^{-1}$ to about $1*10^{-8}$ $s^{-1}$ under 70 MPa tensile stress at 100° C. Similarly, for an AA8017 aluminum alloy, the addition of about 0.01% to about 0.03% erbium can lower the tensile creep rate to about $1*10^{-7}$ $s^{-1}$ to about $1*10^{-8}$ $s^{-1}$ under 70 MPa tensile stress at 100° C.

Similarly, the tensile stress relaxation resistance of an improved AA8030 aluminum alloy including about 0.01% to about 0.03% erbium can improve the tensile stress relaxation time required to reach about 85% of an initial stress of 75 MPa, when measured at 25° C., to about 1,200 seconds to about 1,700 seconds. As can be appreciated, this is about a 2× improvement in stress relaxation times. For AA8176 and AA8017, the addition of about 0.01% to about 0.05% erbium can improve the tensile stress relaxation time required to reach 88% of an initial stress of 75 MPa, when measured at 25° C. to 2,500 seconds or greater for each alloy.

As can be appreciated however, the inclusion and modification of the elements in an aluminum alloy can have a dramatic impact on various characteristics of the alloy. For example, the inclusion of about 0.03% zirconium can improve the creep and stress relaxation properties of an aluminum alloy but can undesirably lower the electrical conductivity of the alloy by about 1% as measured by the International Annealed Copper Standard ("IACS") adopted in 1913. Similarly, including an additional 0.13% copper in an AA8030 alloy containing 0.44% iron and 0.17% copper (to form $AlFe_{0.44}Cu_{0.30}$) can cause a 1.4% IACS decrease in electrical conductivity.

Surprisingly, the addition of a rare earth element as described herein can maintain the characteristics of the original alloy, such as electrical conductivity, while improving the creep resistance and stress relaxation resistance of the original alloy. For example, improved AA8030 aluminum alloys including a rare earth element can maintain an IACS value of about 61.3% to about 61.4% as compared to an IACS value of about 61.2% for a standard AA8030 aluminum alloy formed without the rare earth element.

Without being bound by theory, it is believed that the inclusion of a rare earth element can improve the properties of an aluminum alloy by forming structured nano-precipitates which provide strength to reduce creep and stress relaxation. For example, it is believed that the addition of erbium can form $Al_3Er$ (L12 structure) structured nano-precipitates and the addition of scandium can form $Al_3Sc$ nano-precipitates. As can be appreciated, such nano-precipitates are stable at both room temperature and at elevated temperatures and can be effective in impeding the dislocation motion which causes creep and stress relaxation. It is additionally believed that such nano-precipitates can synergistically work with the precipitates (e.g., nano-precipitates or micro-precipitates) formed from the interactions of the iron and copper found in the unmodified 8000-series aluminum alloy.

For example, in certain embodiments, iron can be included in an aluminum alloy as described herein at about 0.44%, by weight, or greater. Such iron loading levels can ensure that the aluminum alloy has sufficient precipitation of $Al_6(Cu, Fe)$. As can be appreciated, increasing the loading level of copper can lower the electrical conductivity of an aluminum alloy making it more desirable in certain embodiments to increase the weight percentage of iron.

Generally, the aluminum alloys described herein can be formed in any manner known in the art. For example, the aluminum alloys can be formed by casting an as-cast shape, hot rolling the as-cast shape into a redraw rod, and then drawing the redraw rod into a conductive element, such as a wire. This process can be performed continuously. Additional details of forming an aluminum alloy are disclosed in U.S. patent application Ser. No. 15/294,273 and U.S. Patent App. Publication No. 2015/0259773 each of which is incorporated herein by reference.

Cables formed from the aluminum alloys described herein can be useful as cable building wire. In certain embodiments, the cables can be used with standard building connectors such as connectors which comply with the requirements of UL 486A. Generally, the cable building wires can be used as known in the art. For example, the building cable wires can be installed and used in compliance with NECA/AA 104-2000 standards.

The cable building wires can be formed in any suitable manner. For example, the metal alloys described herein can be formed into stranded or solid conductors in various embodiments. Additionally, the cable building wires can be formed of any suitable gauge as determined by the various needs of a particular application. For example, in certain embodiments, building cable wires can be 8 American wire gauge ("AWG"), 10 AWG, or 12 AWG. Additionally, the building cable wire can be coated with an insulator or jacket as known in the art. The building cable wires disclosed herein can weigh less than a copper building cable wire conducting a similar amount of ampacity.

The aluminum alloys described herein can also be used to form alternative articles in certain embodiments. For example, the aluminum alloys can be used to form conductive elements inside of a power receptacle or can be used to form articles which must be resistant to creep.

EXAMPLES

Tables 1 to 3 depict the mechanical and electrical properties of several Example aluminum alloys. The measured properties include the ultimate tensile strength ("UTS"), the elongation at break, the electrical conductivity as measured by the International Annealed Copper Standard ("IACS"), the tensile creep rate as measured at 100° C. under 70 MPa of applied stress, and the tensile stress relaxation time as measured by the time the stress of a sample reaches 88% (Tables 1 and 3) or 85% (Table 2) of the initial stress when measured at 25° C. Ultimate tensile strength was measured in accordance to ASTM B941 (2016); tensile creep was measured in accordance to ASTM E139 (2011); and tensile stress relaxation time was measured in accordance to ASTM E328 (2013).

Table 1 depicts examples of AA8017 aluminum alloys. Table 2 depicts examples of AA8030 aluminum alloys. Table 3 depicts examples of AA8176 aluminum alloys. Additional elements, or impurities, may be present in trace amounts in the disclosed aluminum alloy examples of Tables 1 to 3. For example, each of the AA8017 aluminum alloys in Table 1 and each of the AA8030 aluminum alloys in Table 2 include about 0.02% silicon. As can be appreciated, such examples remain AA8030 aluminum alloys and AA8017 aluminum alloys respectively as the compositions remain with the standards of the named aluminum alloys.

TABLE 1

| Example | UTS (MPa) | Elongation at break (%) | IACS (%) | Tensile creep rate ($s^{-1}$) | Tensile stress relaxation to 88% initial stress (s) |
|---|---|---|---|---|---|
| Ex. 1 (Comp.)- AA8017 ($AlFe_{0.55}Cu_{0.17}Mg_{0.03}$) | 107 ± 1 | 16 ± 2 | 61.0 | ~$2*10^{-6}$ | 1,050 |
| Ex. 2 (Inv.) - AA8017 ($AlFe_{0.55}Cu_{0.17}Mg_{0.03}Er_{0.02}$) | 115 ± 1 | 14 ± 1 | 60.8 | ~$7*10^{-7}$ | 2,750 |

TABLE 2

| Example | UTS (MPa) | Elongation at break (%) | IACS (%) | Tensile creep rate ($s^{-1}$) | Tensile stress relaxation to 85% initial stress (s) |
|---|---|---|---|---|---|
| Ex. 3 (Comp.) - AA8030 ($AlFe_{0.44}Cu_{0.17}$) | 96 ± 1 | 23 ± 2 | 61.2 | ~$1*10^{-3}$ | 650 |
| Ex. 4 (Inv.) - AA8030 ($AlFe_{0.44}Cu_{0.17}Er_{0.01}$) | 101 ± 1 | 21 ± 2 | 61.3 | ~$1*10^{-5}$ | 1,350 |
| Ex. 5 (Inv.) - AA8030 ($AlFe_{0.44}Cu_{0.17}Er_{0.02}$) | 100 ± 1 | 20 ± 2 | 61.4 | ~$1*10^{-5}$ | 1,210 |
| Ex. 6 (Inv.) - AA8030 ($AlFe_{0.44}Cu_{0.17}Er_{0.03}$) | 101 ± 1 | 20 ± 2 | 61.4 | ~$1*10^{-5}$ | 1,400 |
| Ex. 7 (Inv.) - AA8030 ($AlFe_{0.44}Cu_{0.17}Er_{0.04}$) | 100 ± 1 | 21 ± 2 | 60.8 | ~$1*10^{-5}$ | 1,700 |

TABLE 3

| Example | UTS (MPa) | Elongation at break (%) | IACS (%) | Tensile creep rate ($s^{-1}$) | Tensile stress relaxation to 88% initial stress (s) |
|---|---|---|---|---|---|
| Ex. 8 (Comp.) - AA8176 ($AlFe_{0.55}Si_{0.04}$) | 98 ± 2 | 14 ± 1 | 60.6 | ~$2*10^{-6}$ | 220 |
| Ex. 9 (Inv.) - AA8176 ($AlFe_{0.55}Si_{0.04}Er_{0.005}$) | 106 ± 2 | 10 ± 2 | 60.3 | ~$2*10^{-7}$ | 650 |
| Ex. 10 (Inv.) - AA8176 ($AlFe_{0.55}Si_{0.04}Er_{0.01}$) | 116 ± 2 | 8 ± 1 | 60.6 | ~$2*10^{-8}$ | 2,550 |
| Ex. 11 (Inv.) - AA8176 ($AlFe_{0.55}Si_{0.04}Er_{0.02}$) | 127 ± 1 | 5 ± 0.5 | 60.6 | <$1*10^{-8}$ | 3,050 |
| Ex. 12 (Inv.) - AA8176 ($AlFe_{0.55}Si_{0.04}Er_{0.03}$) | 133 ± 1 | 6 ± 1 | 60.5 | <$1*10^{-8}$ | 3,900 |
| Ex. 13 (Inv.) - AA8176 ($AlFe_{0.55}Si_{0.04}Er_{0.05}$) | 136 ± 1 | 3 ± 0.1 | 60.7 | <$1*10^{-8}$ | 4,900 |

As depicted by Tables 1 to 3, the inventive examples (Inv.) exhibited significantly improved tensile creep resistance and tensile stress relaxation resistance as compared to their respective comparative examples (Comp.) while maintaining electrical conductivity.

It should be understood that every maximum numerical limitation given throughout this specification includes every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

Every document cited herein, including any cross-referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests, or discloses any such invention. Further, to the extent that any meaning or definition of a term in this document conflicts with any meaning or definition of the same term in a document incorporated by reference, the meaning or definition assigned to that term in the document shall govern.

The foregoing description of embodiments and examples has been presented for purposes of description. It is not intended to be exhaustive or limiting to the forms described. Numerous modifications are possible in light of the above teachings. Some of those modifications have been discussed and others will be understood by those skilled in the art. The embodiments were chosen and described for illustration of ordinary skill in the art. Rather it is hereby intended the scope be defined by the claims appended various embodiments. The scope is, of course, not limited to the examples or embodiments set forth herein, but can be employed in any number of applications and equivalent articles by those of hereto.

What is claimed is:

1. A building wire formed from an improved 8000-series aluminum alloy comprising, by weight:

0.44% to about 0.80% iron;

about 0.10% to about 0.3% copper;

about 0.02% to 0.04% silicon; and about 0.001% to about 0.1% of a rare earth element selected from one or more of erbium, ytterbium, and scandium;

wherein the improved 8000-series aluminum alloy exhibits an elongation at break of 10% or greater in accordance with ASTM B800-05 (2015);

wherein the improved 8000-series aluminum alloy exhibits one or more of:

i) a tensile creep rate of about $1*10^{-5}$ $s^{-1}$ to about $2*10^{-8}$ $s^{-1}$ when measured in accordance to ASTM E139 (2011) at 100° C. with 70 MPa of applied stress; and ii) a tensile stress relaxation time of about 1,000 seconds or greater to reach about 85% of an initial tensile stress of 75 MPa when measured in accordance to ASTM E328 (2013) at 25° C.; and wherein the improved 8000-series aluminum alloy is an improved AA8030 aluminum alloy.

2. The building wire according to claim 1, wherein the improved 8000-series aluminum alloy comprises about 0.01% to about 0.03%, by weight, of the rare earth element.

3. The building wire according to claim 1, wherein the rare earth element is selected from one or more of erbium and ytterbium.

4. The building wire according to claim 1 exhibits an elongation at break of about 20% or greater.

5. The building wire according to claim 1, wherein the improved 8000-series aluminum alloy exhibits an electrical conductivity at least as great as the electrical conductivity of a standard AA8030 aluminum alloy free of the rare earth element.

6. The building wire according to claim 1, wherein the improved 8000-series aluminum alloy exhibits an electrical conductivity of about 60.5% international annealed copper standard ("IACS") or greater.

7. The building wire according to claim 1, wherein the improved 8000-series aluminum alloy comprises, by weight, about 0.01% to about 0.05% magnesium.

8. The building wire according to claim 1 exhibits an ultimate tensile strength of about 100 MPa or more when measured in accordance to ASTM B941 (2016).

9. The building wire according to claim 1 is a 12 American wire gauge ("AWG") building wire and is configured for use with a wiring terminal or socket.

* * * * *